US008721134B1

(12) United States Patent
Kliegl et al.

(10) Patent No.: US 8,721,134 B1
(45) Date of Patent: May 13, 2014

(54) RETROFIT KIT FOR A HANGING LIGHT

(71) Applicants: Robert S. Kliegl, Putnam Valley, NY (US); James Y. Cameron, S Nyack, NY (US); Cameron M. Travers, Valley Cottage, NY (US); Bruce McFarlane, Cornwall, NY (US); Gary R. Leonard, Wappingers Falls, NY (US); Ronald Ornder, Mountain Lakes, NJ (US)

(72) Inventors: Robert S. Kliegl, Putnam Valley, NY (US); James Y. Cameron, S Nyack, NY (US); Cameron M. Travers, Valley Cottage, NY (US); Bruce McFarlane, Cornwall, NY (US); Gary R. Leonard, Wappingers Falls, NY (US); Ronald Ornder, Mountain Lakes, NJ (US)

(73) Assignee: Production Resource Group, LLC, New Windsor, NY (US)

( * ) Notice: Subject to any disclaimer, the term of this patent is extended or adjusted under 35 U.S.C. 154(b) by 0 days.

(21) Appl. No.: 13/918,102

(22) Filed: Jun. 14, 2013

(51) Int. Cl.
*F21V 29/00* (2006.01)
*F21S 8/00* (2006.01)

(52) U.S. Cl.
USPC ..... 362/368; 362/370; 362/373; 362/396; 362/648; 362/287; 362/294

(58) Field of Classification Search
None
See application file for complete search history.

(56) References Cited

U.S. PATENT DOCUMENTS

| | | | | |
|---|---|---|---|---|
| 2010/0110699 | A1* | 5/2010 | Chou | 362/365 |
| 2012/0113642 | A1* | 5/2012 | Catalano | 362/249.02 |
| 2012/0206926 | A9* | 8/2012 | Chou | 362/365 |
| 2012/0262921 | A1* | 10/2012 | Boomgaarden et al. | 362/249.02 |
| 2013/0235587 | A1* | 9/2013 | Tickner et al. | 362/294 |

OTHER PUBLICATIONS

Drone Plasma Spot Retrofit Kit, 2012.
RT-ES4 Retrofit , 2013.

* cited by examiner

*Primary Examiner* — Ashok Patel
(74) *Attorney, Agent, or Firm* — Law Office of Scott C. Harris, Inc.

(57) ABSTRACT

A retrofit kit for an existing light, that has a prewired assembly, including a housing having wiring to electrical mains, an LED light source, at least one control for said LED light source, both said LED light source and said control being wired to said wiring, and said housing having a at least one mounting device that fits on existing structure of the existing light. The mounting structure can include tabs, for example, that attach to hanging part of the light, or can include a part that attaches to the existing surfaces on the housing of the light that previously held the socket for the existing bulb.

19 Claims, 5 Drawing Sheets

RETROFIT KIT FOR A HANGING LIGHT

BACKGROUND

Lighting systems are evolving to replace incandescent lamps with LED lamps. LEDs can produce less heat per watt, making a more efficient light.

Existing lights can be made more current by changing the lamp.

However, the inventors recognize that it should be easy to do.

SUMMARY

The present application describes a hanging light with a u-shaped hanging clamp, and a retrofit kit and system for the hanging light to change the light to have an LED light source. The retrofit kit includes parts optimized for cooling the LED, and parts that attach to the existing light.

BRIEF DESCRIPTION OF THE DRAWINGS in the drawings.

DETAILED DESCRIPTION

Figure 1:
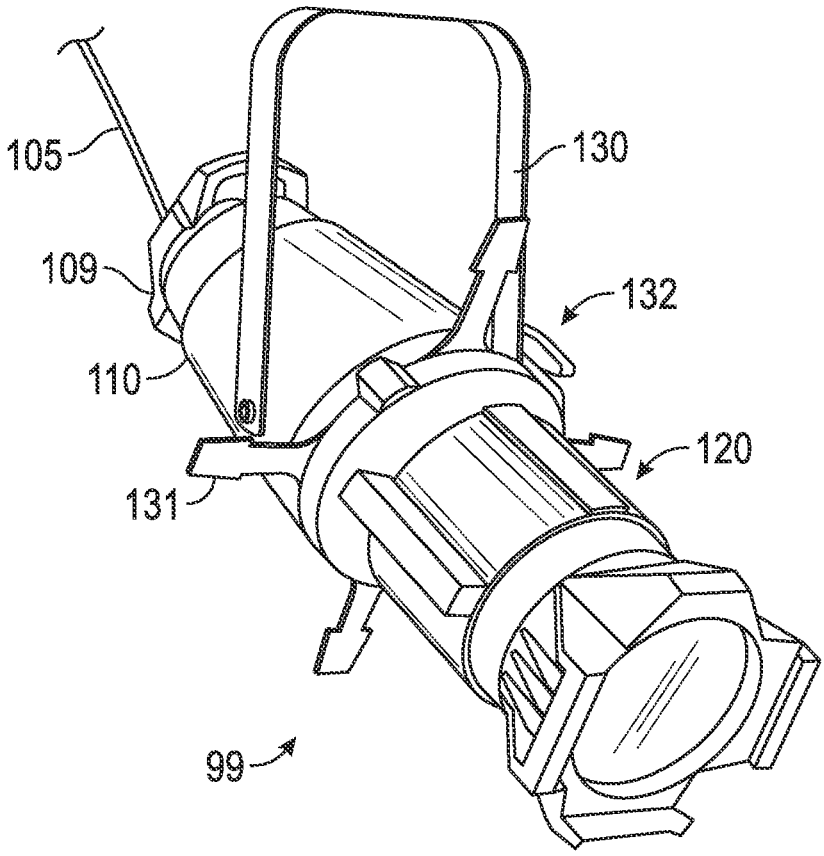
FIG. 1 shows an existing light of a type to be retrofitted.

FIG. 1 shows a conventional quartz fixture of the type contemplated for upgrade herein. The light shown in FIG. 1 is the ETC source 4™ ellipsoidal light, which has a tungsten lamp therein driven from electrical power. The light output is sent through a lens assembly 120. The whole light hangs on a light bracket 130. The light bracket 130 connects to two sides of the light housing; both at first side 131 and second side 132 of the light bracket. The bracket also includes various support features thereon, e.g. holes. In operation, the light receives power via power cord 105, which causes the bulb/lamp in lighting area 110 to be energized, outputting light that is output through the lens assembly 120.

Figure 2:
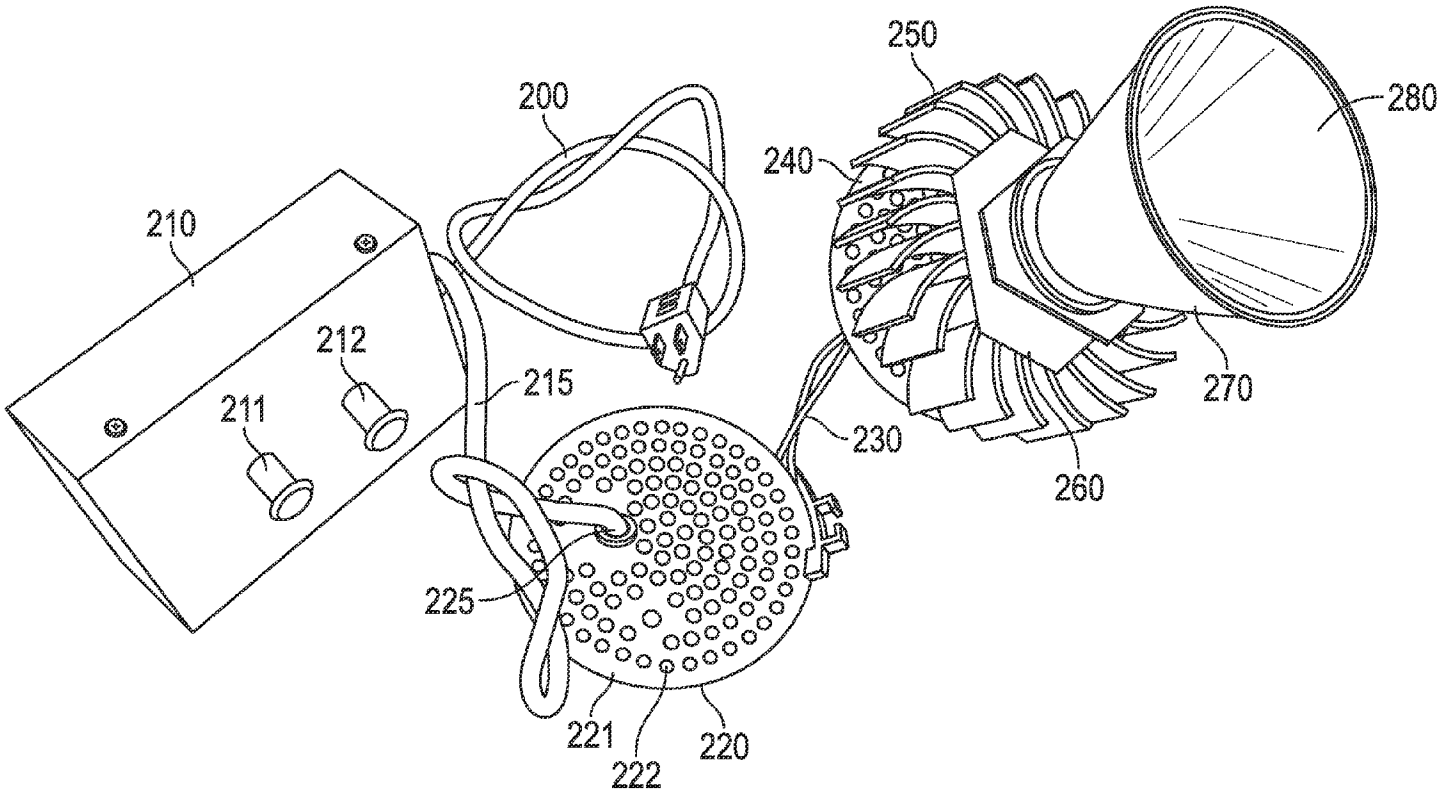
FIG. 2 shows the parts of a first embodiment of the kit.
Figure 3:
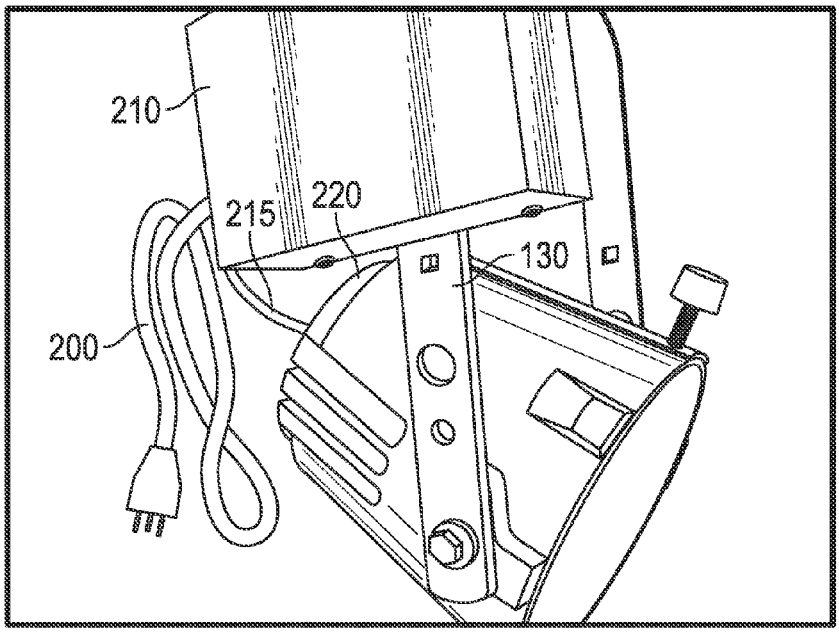
FIGS. 3 and 4 show the parts being attached to the light to retrofit the light according to the first embodiment.

FIG. 2 shows the parts making up a first embodiment of a no-tool retrofit kit for a light of this type. Importantly, the retrofit can be carried out without making any electrical connections, and with using minimal or no tools, and in a way that mounts a retrofit housing on the existing light housing. The retrofit housing can include circuitry, power connection(s), transformer/ballast, and anything else that might be needed for the connection. In an embodiment described herein, a single low voltage electrical connection is made via quick connection from the LED engine to the driver. Also, a connection to mains power is made to obtain the initial power.

This is done in large part by recognizing the inherent differences between the operation using a tungsten lamp and an LED light, and providing a pre-wired and attached assembly. Specifically, and as shown in FIG. 2, the retrofit kit includes a prewired system including an electrical cord 200, wired into a transformer assembly 210 that creates the low voltage output and also control controls or create any control necessary to control the LED.

The transformer assembly 210 is wired through a replacement backplate 220. One side of the wire 215 fits into a grommet, shown as 225 which extends through the replacement backplate 220. Unlike the backplate in the conventional light, the replacement backplate 220 is perforated with a number of small holes such as 221, 222. These holes facilitate allowing airflow into the inside of the lamp housing.

The output wire on the inside of the grommet 230 is extending to and prewired to a support piece 240, which is also a perforated piece, which is attached to the heatsink 250. There may also be a fan and/or other form of forced air flow. The heatsink 250 is attached to an LED mounting mechanism 260. In this embodiment, the LED mounting mechanism 260 has a reflector assembly 270 mounted thereon with an LED lighting unit 280 mounted therein.

Two new backpieces are thus installed (220 and 240), both of which are perforated to allow airflow. One of the pieces (240) is attached to the LED/heatsink assembly, so no assembly of those parts needs to be done. These devices have clips and allow attaching them to the light in place of the existing parts.

In operation, the parts of the retrofit kit make it very easy to retrofit a light. First, the light 99 in FIG. 1 is disassembled, by first removing the lens assembly 120, and then removing the backplate 109 with its electric cord and lighting part. Lights such as the Ellipsoidal source 4 which have replaceable bulbs make it easy to remove the rear part, since this is the way in which the bulb is replaced.

Next, the retrofit kit is attached. First, the transformer box 210 is attached, using the tables 211, 212 to attach to one of the arms of the existing clamp 130 that holds the existing light 99. This provides support for the new transformer box, without needing any tools. The electric wire 200 will be plugged in, and the opposite wire 215 is placed in location, with the perforated new back part 220 being attached on the back of the lighting device. This uses the same connections that the original back used. At this point, the new lighting portion is prewired into place, and needs only to be clipped in. The rear support 240 which is a new perforated support is clipped in, which attaches the heatsink 250, and the LED assembly 260.

Note that this leaves the back of the light with only perforated back parts 220, 240, thus allowing airflow through the back of the light to cool the heatsink and hence cool the LED assembly.

The LED assembly 260 may or may not include a reflector.

Figure 4:
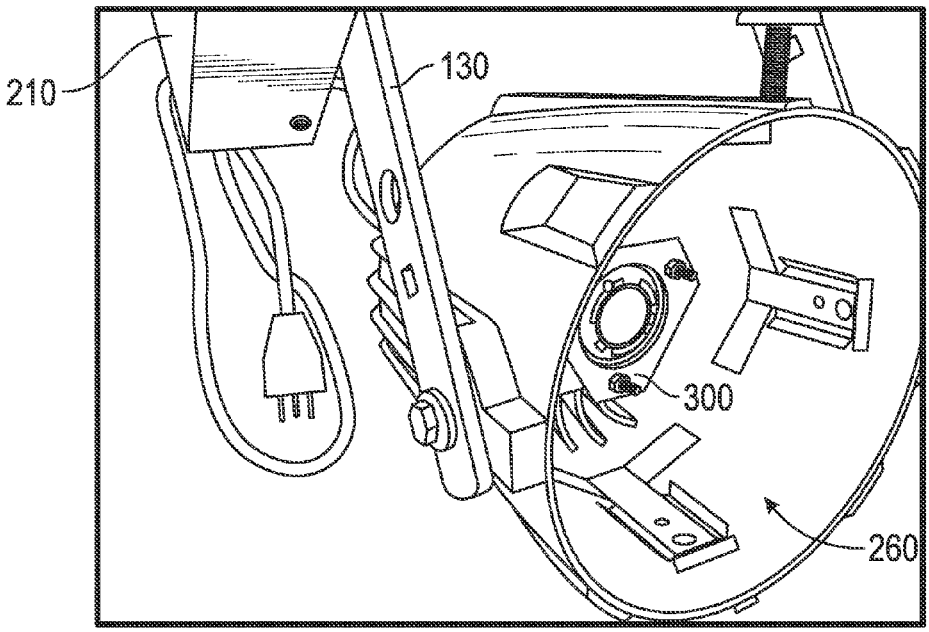

FIG. 4 shows an additional view of the retrofitted light, showing the transformer box attached onto the clamp 130 and also showing the new lighting assembly 260 attached into the inside of the light housing. This embodiment of the new lighting assembly does not include a reflector, so the LED element 300 can be seen on the heatsink.

Figure 5:
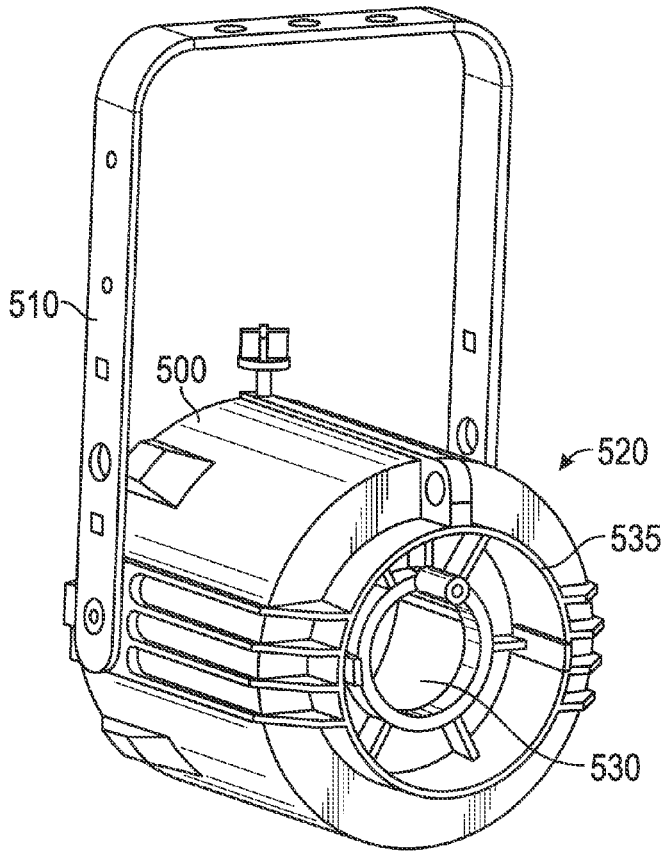
FIG. 5 shows a rear view.
Figure 6:
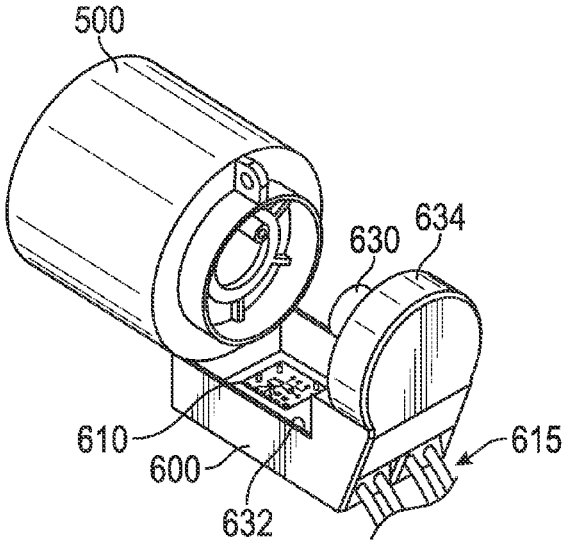
FIG. 6 shows another retrofit kit embodiment.
Figure 7:
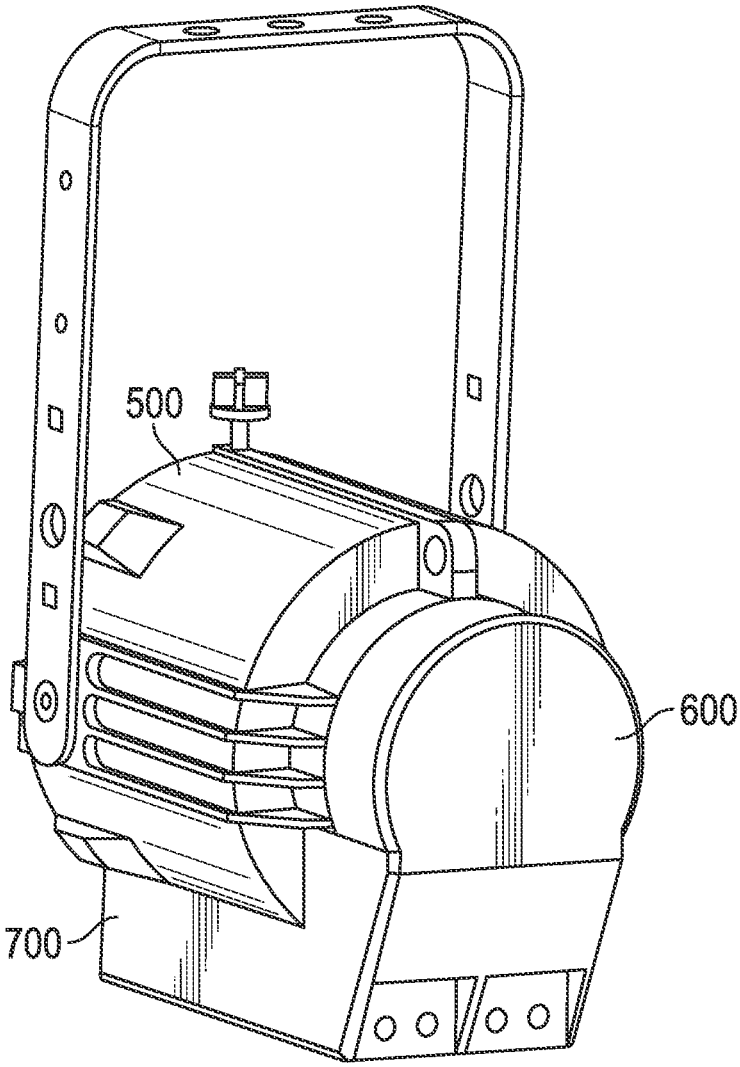
FIG. 7 shows the light retrofitted using the kit of the second embodiment.

FIGS. 5-7 show a second embodiment, which again includes a retrofit housing that attaches to the existing housing of the light. FIG. 5 shows a diagram including the housing 500 and hanging bracket 510 that is attached to the housing. In this figure as shown, the rear portion of the light has been removed, and the back of the housing 520 is shown with an opening 530 through which the lamp usually extends. Again, this light is disassembled by removing the lamp socket in the same way one would remove it to replace the bulb.

In this embodiment, there is also an attachment surface 535 which extends around an area of the inside of the light. This surface 535 may be the same service that usually holds the lighting socket that will be used to hold the lamp/bulb. As in the other embodiments, this embodiment is retrofitted using an attachment housing that attaches to the existing housing. FIG. 6 shows the attachment housing and how it will be attached to the existing housing. Existing housing 500 is shown, and the retrofit housing 600 is shown as having a bottom shelf portion holding a circuit board 610 and also holding any transformer or ballast which may be used for the LED device 630. Note in this embodiment that the housing 500 of the existing light includes a round outer shape. There may be other features on the housing, but at least part of the housing is rounded outer shape. The retrofit housing 600 also includes a rounded outer shape that is the same size as, and mates with the round outer shape of the housing. Therefore, the retrofit housing forms a tray that is attached to the bottom part of the existing housing 500. Thus, the retrofit housing 610 press against existing outer surfaces of the light housing 500.

Input and output wires 615 extends through back holes in the retrofit housing 600, and attached to the circuit board. The circuit board also includes wiring that is attached to the LED device 630. The attachment housing 610 includes bottom surfaces 632 that are sized to press against the outer sides of the housing 500. There is also a back housing 634 that is sized to be slightly larger than the attachment surface 535, and thus fit around that surface 535.

FIG. 7 shows the retrofitted light, showing the main housing 500, and the attachment housing 600 attached to the main housing. This is called a tool-less operation, but in reality may require the same tools that are necessary in order to change the lighting bowl. The main housing can be retrofitted by attaching the attachment housing and the attachment housing has the area shown as 700 which can hold the driver for the LED light and can also hold circuitry.

In one embodiment, the circuitry can be a DMX driver or other network connection.

In this embodiment, the back portion of the retrofit housing 600 may also include perforations, and there may also be heatsinks or other devices including active cooling structures in order to cool the LED device.

Although only a few embodiments have been disclosed in detail above, other embodiments are possible and the inventors intend these to be encompassed within this specification. The specification describes certain technological solutions to solve the technical problems that are described expressly and inherently in this application. This disclosure describes embodiments, and the claims are intended to cover any modification or alternative or generalization of these embodiments which might be predictable to a person having ordinary skill in the art. For example, other forms of housings and attachments can be used. An important part of the present system, however, is that there are housing parts that attach to retrofit the existing hanging light.

Those of skill would further appreciate that the various illustrative logical blocks, modules, circuits, and algorithm steps described in connection with the embodiments disclosed herein may be implemented as electronic hardware, computer software running on a specific purpose machine that is programmed to carry out the operations described in this application, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the exemplary embodiments.

The various illustrative logical blocks, modules, and circuits described in connection with the embodiments disclosed herein, may be implemented or performed with a general or specific purpose processor, or with hardware that carries out these functions, e.g., a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. The processor can be part of a computer system that also has an internal bus connecting to cards or other hardware, running based on a system BIOS or equivalent that contains startup and boot software, system memory which provides temporary storage for an operating system, drivers for the hardware and for application programs, disk interface which provides an interface between internal storage device(s) and the other hardware, an external peripheral controller which interfaces to external devices such as a backup storage device, and a network that connects to a hard wired network cable such as Ethernet or may be a wireless connection such as a RF link running under a wireless protocol such as 802.11. Likewise, external bus 18 may be any of but not limited to hard wired external busses such as IEEE-1394 or USB. The computer system can also have a user interface port that communicates with a user interface, and which receives commands entered by a user, and a video output that produces its output via any kind of video output format, e.g., VGA, DVI, HDMI, displayport, or any other form. This may include laptop or desktop computers, and may also include portable computers, including cell phones, tablets such as the IPAD™ and Android platform tablet, and all other kinds of computers and computing platforms.

A processor may also be implemented as a combination of computing devices, e.g., a combination of a DSP and a microprocessor, a plurality of microprocessors, one or more microprocessors in conjunction with a DSP core, or any other such configuration. These devices may also be used to select values for devices as described herein.

The steps of a method or algorithm described in connection with the embodiments disclosed herein may be embodied directly in hardware, in a software module executed by a processor, using cloud computing, or in combinations. A software module may reside in Random Access Memory (RAM), flash memory, Read Only Memory (ROM), Electrically Programmable ROM (EPROM), Electrically Erasable Programmable ROM (EEPROM), registers, hard disk, a removable disk, a CD-ROM, or any other form of tangible storage medium that stores tangible, non transitory computer based instructions. An exemplary storage medium is coupled to the processor such that the processor can read information from, and write information to, the storage medium. In the alternative, the storage medium may be integral to the processor. The processor and the storage medium may reside in reconfigurable logic of any type.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer.

The memory storage can also be rotating magnetic hard disk drives, optical disk drives, or flash memory based storage drives or other such solid state, magnetic, or optical storage devices. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media. The computer readable media can be an article comprising a machine-readable non-transitory tangible medium embodying information indicative of instructions that when performed by one or more machines result in computer implemented operations comprising the actions described throughout this specification.

Operations as described herein can be carried out on or over a website. The website can be operated on a server computer, or operated locally, e.g., by being downloaded to the client computer, or operated via a server farm. The website can be accessed over a mobile phone or a PDA, or on any other client. The website can use HTML code in any form, e.g., MHTML, or XML, and via any form such as cascading style sheets ("CSS") or other.

The computers described herein may be any kind of computer, either general purpose, or some specific purpose computer such as a workstation. The programs may be written in C, or Java, Brew or any other programming language. The programs may be resident on a storage medium, e.g., magnetic or optical, e.g. the computer hard drive, a removable disk or media such as a memory stick or SD media, or other removable medium. The programs may also be run over a network, for example, with a server or other machine sending signals to the local machine, which allows the local machine to carry out the operations described herein.

Also, the inventor(s) intend that only those claims which use the words "means for" are intended to be interpreted under 35 USC 112, sixth paragraph. Moreover, no limitations from the specification are intended to be read into any claims, unless those limitations are expressly included in the claims.

Where a specific numerical value is mentioned herein, it should be considered that the value may be increased or decreased by 20%, while still staying within the teachings of the present application, unless some different range is specifically mentioned. Where a specified logical sense is used, the opposite logical sense is also intended to be encompassed.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A retrofit kit for an existing light, comprising:

a prewired assembly, including a housing having wiring to electrical mains, an LED light source, at least one control for said LED light source, both said LED light source and said control being wired to said wiring, and said housing having a at least one mounting device that fits on existing structure of the existing light, wherein said existing light has a hanging clamp that attaches to a first housing of the existing light both at a first side and at a second side, and where the existing light pivots to create its light output in different directions by pivoting relative to said hanging clamp, where said hanging clamp attaches to a support piece to hang said light from said support piece, and where said mounting device fits on and attaches to the hanging clamp of said light to hold said housing to said hanging clamp.

2. The kit as in claim 1, wherein the housing has a back plate that are perforated to allow airflow and where the back plate replaces a back plate on the existing light that is not perforated.

3. The kit as in claim 1, wherein said prewired assembly includes a plurality of separated parts that are connected by wires.

4. The kit as in claim 3, wherein at least a first one of said parts is a plate which is perforated to allow airflow for cooling the LED and which replaces an existing back plate of the existing light that is not perforated.

5. The kit as in claim 1, wherein said mounting device holds said housing in a location that is spaced from and outside of the housing of the existing light.

6. The kit as in claim 5, wherein the mounting device is in a rectangular housing, and includes tabs that extend outside the rectangular housing, to fit into existing holes in the hanging clamp.

7. The kit as in claim 1, wherein the housing includes cooling structure for the LED light source.

8. The kit as in claim 7, wherein the housing also includes a power supply device for the LED light source that is prewired.

9. The kit as in claim 8, wherein the housing also includes electronic control circuitry for the LED light source that responds to a remotely sensed control indicating operation of the LED light source.

10. A retrofit kit for an existing light, comprising:

a prewired assembly, including a housing having wiring to electrical mains, an LED light source, at least one control for said LED light source, both said LED light source and said control being wired to said wiring, and said housing having a at least one mounting device that fits on existing structure of the existing light, wherein the existing light includes a housing with a round outer shape, and the mounting device fits on surfaces of the housing of the existing light and has surfaces that press against the outer surface of the housing of the existing light, and the mounting device includes an outer part that attaches to the round outer shape of the housing of the existing light, and also has an additional part that attaches outside the round outer shape, the additional part having wires connected thereto and having a control part, and the outer part having said LED light source therein.

11. A method of retrofitting an existing lighting device, comprising:

hanging the existing light in an existing housing on a hanging clamp by attaching to a support;

pivoting the existing light relative to the hanging clamp, the pivoting comprising moving the housing relative to the hanging clamp and relative to the support without moving the hanging clamp;

removing a lamp socket of a type that holds a replaceable lamp from the existing housing;

replacing said lamp socket with a retrofit housing of a type that attaches to surfaces on the existing housing, and which includes a prewired LED included therein, and which also includes a power supply in the retrofit housing, that is prewired for the prewired LED;

wherein said replacing comprises attaching the retrofit housing to an existing surface of the hanging clamp, so that the retrofit housing hangs on the hanging clamp spaced from the existing housing.

12. The method as in claim 11, wherein said replacing comprises replacing a portion of the housing that is not perforated, with a perforated portion that has plates that are perforated to allow airflow.

13. The method as in claim 11, wherein said replacing comprises using a plurality of separated parts which are each prewired together and are prewired to an electrical mains connection.

14. The method as in claim 13, wherein said replacing comprises replacing a back part of the existing housing that is not perforated, with a perforated back part that is prewired to include a wire extending there through.

15. The method as in claim 11, wherein said attaching comprises using tabs on the retrofit housing to attach to existing holes in the hanging clamp that holds the lamp.

16. The method as in claim 11, wherein the existing light includes a housing with a round outer shape, and the mounting device fits on surfaces of the existing housing, and includes an outer part that fits to the around outer shape of the housing of the existing light.

17. The method as in claim 11, wherein the retrofit kit includes structure for cooling the LED, by replacing a portion of the housing with another portion that is optimized for cooling the LED.

18. The method as in claim 11, wherein the retrofit kit includes a prewired transformer device for the LED.

19. The method as in claim 11, further comprising remotely communicating with said retrofitting kit using structure that is prewired into the retrofit kit.

* * * * *